US010233589B2

(12) United States Patent
Wild et al.

(10) Patent No.: US 10,233,589 B2
(45) Date of Patent: Mar. 19, 2019

(54) COMPOSITION FOR THE PERMANENT HYDROPHILIC FINISHING OF TEXTILE FIBERS AND TEXTILE PRODUCTS

(71) Applicant: SCHILL + SEILACHER GMBH, Boeblingen (DE)

(72) Inventors: Christine Wild, Magstadt (DE); Wolfgang Warncke, Tuebingen (DE); Michaela Munza, Sindelfingen (DE)

(73) Assignee: SCHILL + SEILACHER GMBH, Boeblingen (DE)

( * ) Notice: Subject to any disclaimer, the term of this patent is extended or adjusted under 35 U.S.C. 154(b) by 0 days.

(21) Appl. No.: 15/538,047

(22) PCT Filed: Dec. 21, 2015

(86) PCT No.: PCT/EP2015/080797
§ 371 (c)(1),
(2) Date: Jun. 20, 2017

(87) PCT Pub. No.: WO2016/102470
PCT Pub. Date: Jun. 30, 2016

(65) Prior Publication Data

US 2018/0179700 A1 Jun. 28, 2018

(30) Foreign Application Priority Data

Dec. 22, 2014 (DE) ..... 10 2014 119 332

(51) Int. Cl.

| | |
|---|---|
| ***D04H 1/4291*** | (2012.01) |
| ***D06M 15/643*** | (2006.01) |
| ***D06M 13/148*** | (2006.01) |
| ***D06M 13/402*** | (2006.01) |
| ***D06M 13/46*** | (2006.01) |
| ***D06M 15/333*** | (2006.01) |
| ***D04H 3/007*** | (2012.01) |
| ***D06M 11/72*** | (2006.01) |
| ***D06M 13/165*** | (2006.01) |
| ***D06M 13/224*** | (2006.01) |
| ***D06M 13/292*** | (2006.01) |
| ***D06M 13/144*** | (2006.01) |
| ***D06M 13/463*** | (2006.01) |
| *D06M 101/20* | (2006.01) |
| *D06M 101/32* | (2006.01) |
| *D06M 101/18* | (2006.01) |

(52) U.S. Cl.
CPC ..... *D06M 15/6436* (2013.01); *D04H 1/4291* (2013.01); *D04H 3/007* (2013.01); *D06M 11/72* (2013.01); *D06M 13/144* (2013.01); *D06M 13/148* (2013.01); *D06M 13/165* (2013.01); *D06M 13/224* (2013.01); *D06M 13/2243* (2013.01); *D06M 13/292* (2013.01); *D06M 13/402* (2013.01); *D06M 13/46* (2013.01); *D06M 13/463* (2013.01); *D06M 15/333* (2013.01); *D06M 15/643* (2013.01); *D06M 2101/18* (2013.01); *D06M 2101/20* (2013.01); *D06M 2101/32* (2013.01)

(58) Field of Classification Search
USPC ..... 442/118
See application file for complete search history.

(56) References Cited

U.S. PATENT DOCUMENTS

| | | | |
|---|---|---|---|
| 5,045,387 | A | 9/1991 | Schmalz |
| 6,008,145 | A | 12/1999 | Dzen et al. |
| 2005/0266053 | A1 | 12/2005 | Wild et al. |
| 2015/0292144 | A1 | 10/2015 | Kraus et al. |

FOREIGN PATENT DOCUMENTS

| | | | |
|---|---|---|---|
| CN | 1723240 | A | 1/2006 |
| DE | 19645380 | A1 | 5/1998 |
| DE | 602 12 094 | T2 | 6/2007 |
| DE | 10 2012 021 742 | A1 | 5/2014 |
| EP | 0839947 | A2 | 5/1998 |
| EP | 0869168 | A2 | 10/1998 |

OTHER PUBLICATIONS

German Search Report appended to German priority application issued to counterpart application No. DE 10 2014 119 332.6 dated Aug. 26, 2015.

*Primary Examiner* — Terressa Boykin
(74) *Attorney, Agent, or Firm* — McNees Wallace & Nurick LLC

(57) ABSTRACT

A composition to be used for providing a permanent hydrophilic finishing of textile fibers and textile products made thereof consists of a hydrophilically modified or amphoteric polydimethylsiloxane in a proportion of 3 to 30 weight percent, a quaternary ammonium compound in a proportion of 25 to 85 weight percent, the quaternary ammonium compound having a melting point of at least 55° C.; a fatty alcohol having a melting point of at least 60° C. in a proportion of 0 to 25 weight percent; a non-ionic consistency enhancer in a proportion of 0 to 40 weight percent and at least one dispersion additive in a proportion of 0 to 10 weight percent. The composition is preferably present as granulate and has a melting point of at least 45° C.

17 Claims, No Drawings

COMPOSITION FOR THE PERMANENT HYDROPHILIC FINISHING OF TEXTILE FIBERS AND TEXTILE PRODUCTS

FIELD OF THE INVENTION

The invention relates to a composition for permanent hydrophilic finishing of textile fibers and textile products made of textile fibers such as non-wovens.

BACKGROUND OF THE INVENTION

There exist various methods for producing non-wovens. When forming spun-bonded fabrics by means of spun-bonding or melt-blowing methods, the filaments formed from extruded polymers by melt-spinning are pressed through spinnerets under high pressure, stretched in a hot or cold air stream and piled into a non-woven. The non-woven can then be bonded chemically, mechanically or thermally. When producing airlaid non-wovens, staple fibers are used, which are first carded to form a fibrous web and then bonded chemically, mechanically or thermally.

In particular, hydrophilic non-wovens are used as covering non-wovens or as an intermediate non-woven for sanitary products such as diapers, sanitary towels, incontinence products and similar products. The function of such non-wovens is to quickly transfer body fluids such as urine and blood to the underlying absorption layer.

To produce hydrophilic non-wovens, mostly fibers or filaments made of thermoplastic polymers such as polyolefin or polyester are used. However, these polymers are hydrophobic and have thus to be provided with a hydrophilic finish either during fiber production and/or during further processing into a non-woven. Usually, hydrophilization is performed by treating the filaments with known spin finishings, and the filaments are then further processed into staple fibers and/or directly into non-wovens. Further, it is also common to treat the non-wovens with a hydrophilic finishing agent to form a so-called top coat prior to further processing them into a sanitary product.

The treatment of hydrophobic fibers, filaments or non-wovens with a hydrophilic spin finish or a hydrophilic finishing agent is to result in a hydrophilicity that is as permanent and constant as possible over a long period of useful life of the non-woven. Therefore, the hydrophilic spin finish or the finishing agent should well adhere to the hydrophobic non-woven and must not or only minimally be washed off by liquids. Modern non-wovens should exhibit permanent hydrophilicity and be capable of being repeatedly wetted with water or body fluids such as urine.

So far, the compositions for the hydrophilic finishing of non-wovens and fibers for sanitary applications have been sold either as almost water-free oils or as diluted aqueous dispersions to achieve a permanent hydrophilization of the fibers or non-wovens. The commercially available compositions are then diluted with water on-site during the production of the fibers or non-wovens, applied onto the fibers or non-wovens from the aqueous dilution and then dried.

However, the commercially available oils do not lead to a satisfactory permanent hydrophilic finish. The products provided with such a finish often show insufficient results in the wash-off test and have a tendency towards wet migration. Although the aqueous dispersions show better results regarding the permanent hydrophilic finishing of textile fibers and non-wovens, the high water content of these dispersions can lead to bacterial contamination or hydrolysis of the components used and thus to a limited storage stability.

The patent DE 196 45 380 B4 discloses a composition for permanent hydrophilization of polyolefin fibers comprising cationically modified siloxanes, esterquats and non-ionic surfactants. However, all commercially available compositions contain water and/or solvents and have only limited storage stability.

SUMMARY OF THE INVENTION

It is the object of the invention to provide a composition for permanent hydrophilic finishing of textile fibers and textile products such as non-wovens having an improved storage stability and allowing a stable permanent hydrophilic finishing of textile fibers and textile products.

This object is resolved by a composition for permanent hydrophilic finishing of textile fibers and textile products exhibiting the features of claim 1.

Further advantageous embodiments are stated in the subclaims which can, optionally, be combined with each other.

The composition for permanent hydrophilic finishing of textile fibers and textile products according to the invention consists of:

(A) a hydrophilically modified polyalkylsiloxane in a proportion of 3 to 30 weight percent;

(B) a cationic surfactant based on a quaternary ammonium compound in a proportion of 25 to 85 weight percent, the quaternary ammonium compound having a melting point of at least 45° C.;

(C) an, optionally hydroxylated, fatty alcohol with a melting point of at least 40° C. in a proportion of 0 to 25 weight percent;

(D) a non-ionic consistency enhancer in a proportion of 0 to 40 weight percent, the consistency enhancer having a melting point of at least 45° C. and being selected from the group consisting of alkoxylated C12-C28 fatty alcohols, optionally alkoxylated C12-C28 fatty acid amides, alkoxylated C12-C28 fatty acids, alkoxylated C12-C28 fatty acid esters and optionally alkoxylated C12-C28 fatty acid esters of polyfunctional alcohols, C12-C22 alkyl polyglycosides, synthetic and natural waxes and any mixture thereof; and (E) a hydrotropic dispersion additive in a proportion of 0 to 10 weight percent, based on the total weight of the composition;

the composition having a melting point of at least 45° C.

The composition according to the invention can advantageously be diluted with water and applied from the aqueous dilution onto the fibers or non-wovens to be hydrophilically finished at the customer's facility. Provision as a composition with a melting point of more than 45° C. ensures sufficient storage stability.

The composition according to the invention exhibits a permanent hydrophilic finish of textile fibers and textile products that is comparable to the performance of spin finishes and finishing agents based on aqueous dispersions, while retaining the respective application-technical properties.

The composition according to the invention is preferably present in the form of a granulate allowing both a reduction of the storage and transportation costs and simplified handling at the customer's facility. In addition, the composition, when present in the form of a granulate, is less prone to modified storage conditions.

Alternatively, the composition according to the invention can also be provided as an aqueous dispersion having a solids content of at least 10 weight percent, preferably at least 15 weight percent. Again, the storage stability is distinctly improved as compared to diluted aqueous dispersions.

It is particularly preferred that the melting point of the composition is at least 55° C.

The upper limit of the melting point of the composition according to the invention depends on the components used and the dispersion capacity as well as the desired application properties of the composition. The inventors understand that compositions having a melting point of more than 120° C., preferably more than 90° C., can no longer be reasonably used as finishing agents for textile fibers and textile products.

Mostly, components made of highly viscous or solid materials are used to form the composition according to the invention. Despite this, the application properties of the non-wovens finished with the composition according to the invention such as multiple strike-through, multiple run-off, wetback and wash-off are not affected as compared to the aqueous dispersions used so far. Rather, the fibers and non-wovens treated with the composition according to the invention show a good permanent hydrophilicity and a good absorption rate.

With respect to the invention, the term "fibers" does also comprise "filaments" including single filaments and multifilaments. Thus, the terms, "fibers" and "filaments" are used as synonyms.

Fibers, materials or surfaces which cannot be spontaneously wetted with water or have a contact angle of more than 90°, are called "hydrophobic". Hydrophilic fibers, materials and surfaces can be spontaneously wetted with water and aqueous liquids or have a contact angle of less than 90°.

With respect to the invention, a textile product (fiber or fabric) treated with a finishing agent is considered "permanently hydrophilic" if it passes the multiple strike-through test pursuant to WSP standard 70.7 (11) with strike-through times of <2/ <3/ <5/ <5/ <5 seconds.

Storage stability of the dispersions known from the state of the art is up to approximately 6 months. The compositions according to the invention can be stored for at least 12 months at 22° C. and 50% relative humidity without any deterioration of the product properties, measured by the performance in the multiple strike-through test. Even in the form of highly concentrated dispersions having a solids content of at least 10%, preferably at least 15%, the compositions according to the invention still remain pourable under these conditions. The compositions preferably present as granulates are considered storage stable if the appearance of the granules does not change after warm storage for 3 days at 50 C.

In particular, synthetic fibers or filaments made of polyolefins such as polyethylene and polypropylene and polyesters such as polyethylene terephthalate (PET) and polylactides (PLA) or bicomponent fibers made of polyolefines and polyesters are used as textile fibers. The textile products made of these fibers are especially non-woven textile products, in particular non-wovens.

For the production of the composition according to the invention the components of the composition are melted and mixed with each other while stirring. Then granulation or scaling from the melt is performed; to this end various granulation techniques and scaling methods known from the state of the art can be used

DETAILED DESCRIPTION OF THE INVENTION

Below, the invention is explained by means of several preferred embodiments, which, however, are not to be considered as limiting.

The hydrophilically modified polyalkylsiloxane of component (A) can be cationically or anionically modified or exhibit a non-ionic hydrophilic side group.

Preferably, the hydrophilically modified polyalkylsiloxane has a viscosity of at least 3,500 mPa s at 25° C. Particularly preferably, the viscosity of the polyalkylsiloxane at 22° C. is at least 5,000 mPa s, preferably in the range of 5 to 100 Pa s, especially between 50 and 80 Pa s. The viscosity is measured pursuant to DIN ISO 2555.

According to a preferred embodiment of the invention component (A) preferably comprises a cationically modified polyalkylsiloxane having at least one quaternary ammonium group.

It is particularly preferred that the cationically modified polyalkylsiloxane of component (A) corresponds to one of the below formulas Ia or Ib:

(Ia)

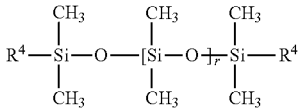

(Ib)

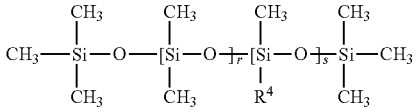

wherein $R^4$ is

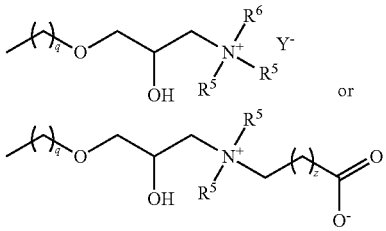

$R^5$ is, independently from each other, $—CH_3$ or $—C_2H_4OH$, preferably $—CH_3$, $R^6$ is $—(CH_2)_x—X—CO—R^7$, $R^7$ is a linear or branched, saturated or unsaturated hydrocarbon chain with 9 to 23 C-atoms, preferably C9-C15 alkyl, X is an oxygen atom or NH, preferably NH, $Y^-$ is one of the anions $CH_3OSO_3^-$, $C_2H_5OSO_3^-$, $CH_3COO^-$, $Cl^-$, phosphate or lactate, preferably $CH_3COO^-$, q is an integer from 3 to 18, preferably from 3 to 6, r and s are, independently from each other, an integer from 1 to 50;

x is an integer from 2 to 10, preferably from 2 to 4, y is an integer from 8 to 22, preferably from 8 to 16 and particularly preferably from 8 to 12, and z is an integer from 0 to 10.

Polyalkylsiloxanes in which the residue $R^4$ bears a free cation are preferred. Alternatively or additionally polyalkylsiloxanes which exhibit an amphoteric betaine structure on the residue $R^4$ can be used.

According to another embodiment the hydrophilically modified polyalkylsiloxane of component (A) comprises a non-ionic alkoxylated polyalkylsiloxane having an α,ω structure or comb structure, optionally terminated by alkyl groups, acyl groups or phosphate groups.

Suitable, highly viscous, hydrophilically modified polyalkylsiloxanes are for example commercially available under the designation TEGOPREN™ from Evonik Industries or as L grade silicone oil from Wacker AG.

The hydrophilically modified polyalkylsiloxane of component (A) imparts the ability to induce fast hydrophilization with a good permanence to the composition according to the invention and improves the absorption capacity of the products provided with the composition according to the invention as a finish.

The proportion of component (A) in the composition according to the invention is in the range of 3 to 30 weight percent, preferably in the range of 10 to 25 weight percent, based on the total weight of the composition. A higher content of component (A) deteriorates the composition's processing and/or granulation capacity and increases the price.

The quaternary ammonium compound according to component (B) of the composition according to the invention preferably corresponds to the below formula II:

$$[(R^1—C(=O)—X—(CH_2)_n—)_mNR^2_{4-m}]^+ \quad (II)$$

wherein $R^1$ can be equal or different and is an alkyl group having 1 to 24 C-atoms or an alkenyl group having 2 to 24 C-atoms;

$R^2$ can be equal or different and, independent from each other, is an alkyl group having 1 to 24 C-atoms, an alkenyl group having 2 to 24 C-atoms, hydroxyethyl or a polyglycol residue;

X is an oxygen atom, NH, N—$CH_3$ or a $(OC_2H_4)_z$ group with z=1 to 10;

$Y^-$ is one of the anions $CH_3OSO_3^-$, $C_2H_5OSO_3^-$, $CH_3COO^-$, $Cl^-$, phosphate, lactate and citrate;

n is an integer from 1 to 6; and m is an integer from 1 to 3.

It is preferred that the residue $R^1$ in the above formula (II) comprises an alkyl group or alkenyl group having 12 to 24 C-atoms.

It is particularly preferred that the quaternary ammonium compound has a melting point of at least 55° C. Due to the selection of quaternary ammonium compounds having a high melting point a good granulation capacity of the composition according to the invention is ensured. Additionally, the quaternary ammonium compound has good permanent hydrophilizing properties.

Suitable quaternary ammonium compounds are commercially available, for example under the designation Dehyquart™ F 75 (BASF).

The proportion of component (B) in the composition according to the invention is in the range of 25 to 85 weight percent, preferably in the range of 25 to 60 weight percent and particularly preferably in the range of 40 to 55 weight percent, based on the total weight of the composition. An excessive amount of the quaternary ammonium compound diminishes the fluid absorption rate, which is reflected by a deteriorated first strike-through value in the multiple strike-through test. If the proportion of the quaternary ammonium compound is too low, the composition's granulation capacity is impaired.

According to another embodiment of the invention the composition can include an, optionally hydroxylated, fatty alcohol in a proportion of 0 to 25 weight percent as component (C). Preferably, the proportion of the fatty alcohol is in a range of 5 to 15 weight percent, especially preferably between 10 and 15 weight percent, based on the total weight of the composition.

The fatty alcohol serves as a solvent for components (A) and (B) and improves the homogeneity and consistency of the granulate. Moreover, the addition of fatty alcohols can improve the composition's storage stability. However, an excessive percentage of fatty alcohol deteriorates the hydrophilizing effect of the composition.

The hydrocarbon chains of the optionally hydroxylated fatty alcohol can be branched or linear, saturated or unsaturated. Fatty alcohols having 16 to 32 C-atoms in the hydrocarbon chain are particularly preferred. Suitable examples are cetyl alcohol (melting point 49° C.) and stearyl alcohol (melting point 59° C.). Mixtures of different fatty alcohols can also be used. A suitable hydroxylated fatty alcohol is 12-hydroxystearyl alcohol (melting point 63° C.).

According to the invention, the non-ionic consistency enhancer of component (D) is selected from the group consisting of the following compounds:

a) alkoxylated C12-C28 fatty alcohols,
b) optionally alkoxylated C12-C28 fatty acid amides,
c) alkoxylated C12-C28 fatty acids,
d) alkoxylated C12-C28 fatty acid esters,
e) optionally alkoxylated C12-C28 fatty acid esters of polyfunctional alcohols,
f) C12-C22 alkyl polyglycosides, and
g) synthetic waxes such as polyalkylene waxes and ester waxes as well as natural waxes, in particular vegetable waxes such as fruit and grain waxes.

The hydrocarbon chains of these compounds can each be branched or linear, saturated or unsaturated. Preferably, the compounds used as consistency enhancers in the compositions according to the invention include at least 16 C-atoms in the hydrocarbon chain.

The alkoxy groups of the above mentioned compounds are preferably ethoxy (EO) groups and/or propoxy (PO) groups. Preferably, the compounds contain up to 10 alkoxy groups, in particular EO and/or PO groups.

The number of alkoxy groups in the non-ionic consistency enhancer is preferably 0 to 10, more preferably 0 to 6 and particularly preferably 2 to 6.

According to the invention, the non-ionic consistency enhancer has a melting point of at least 45° C. Preferably, the melting point is above 55° C.

The fatty alcohol alkoxylates and fatty acid alkoxylates can include a terminal hydroxyl or alkyl or alkenyl ether group. Hydroxy group-terminated fatty alcohol and fatty acid alkoxylates are particularly preferred.

Particularly preferred consistency enhancers are esters of C12-C28 fatty acids with polyfunctional alcohols selected from the group consisting of sorbitol, neopentylglycol, glycerol, trimethylolpropane, pentaerythritol and polyglycerol, glucose and polyglycosides and any mixture thereof. The esters may or may not be alkoxylated, preferably having 0 to 10, more preferably 0 to 6 and particularly preferably 2 to 6 alkoxy groups.

Further, a solid fatty acid amide having 12 to 28 C-atoms in the hydrocarbon chain can be used as a consistency enhancer in the composition according to the invention. The fatty acid amide is especially free of nitrosamines. An example of a suitable fatty acid amide is stearic acid monoethanol amide.

C12-C22 alkyl polyglycosides, especially C12-C22 alkyl polyglucosides, are also suited as consistency enhancers.

The non-ionic consistency enhancer can be used as a single compound or as a mixture of the above mentioned compounds.

A proportion of the consistency enhancer of 40 weight percent of the total composition should not be exceeded as an excessive amount of the consistency enhancer can lead to a poor wetback, a low absorption rate and insufficient permanent hydrophilization.

Preferably, the proportion of the consistency enhancer is in the range of 15 to 35 weight percent, particularly preferably 20 to 30 weight percent, based on the total weight of the composition.

Preferred dispersion additives are hydrotropic compounds, in particular substances from the group of C6-C18 alkyl alkoxylates that are liquid at room temperature, which can be branched, linear, saturated or unsaturated and include up to 6 ethoxy and/or propoxy groups, and amphoteric surfactants, especially betaines, (poly)phosphates, in particular polyphosphate alkaline salts and/or sulfonates such as alkyl sulfonates and cumene sulfonates. Further suitable dispersion additives are polyvinyl alcohols and polyacrylates. The addition of hydrotropic substances can also lower the viscosity of the composition in an aqueous dispersion.

Preferably, the composition is present in the form of a granulate. It is preferred that the granulate is free-flowing. Preferably, the medium grain size of the granules is in the range of 4 to 10 mm.

Alternatively, the composition can also be provided as a concentrated aqueous dispersion with a solid content of at least 10 weight percent, preferably at least 15 weight percent.

The composition according to the invention is preferably used as a spin finish for providing a permanent hydrophilic finishing of polyolefin fibers or polyolefin filaments or as an agent for providing a permanent hydrophilic finishing of non-woven textile fabrics, preferably spun-bonded non-wovens, made of polyolefin fibers or polyolefin filaments.

Preferably, ethylene- or propylene-based homo- or copolymers can be used as a polyolefin.

Examples of such polyolefines are polyethylenes such as HDPE (high-density polyethylene), LDPE (low-density polyethylene), VLDPE (very low-density polyethylene), LLDPE (linear low-density polyethylene), MDPE (medium-density polyethylene), UHMPE (ultra-high molecular polyethylene), VPE (crosslinked polyethylene), HPPE (high-pressure polyethylene); polypropylenes such as isotactic polypropylene; syndiotactic polypropylene, polypropylene produced by metallocene catalysis, impact-modified polypropylene; ethylene- and propylene-based random copolymers, ethylene- and propylene-based block copolymers; EPM (poly[ethylene-co-propylene]); EPDM (poly[ethylene-co-propylene-conjugated diene]).

Further suitable polyolefines are, for example, polystyrene; poly(methylstyrene); poly(oxymethylene); metallocene-catalyzed alpha-olefin or cycloolefin copolymers such as norbornene-ethylene copolymers; copolymers which contain at least 60% ethylene and/or styrene and less than 40% monomers such as vinyl acetate, acrylic acid ester, methacrylic acid ester, acrylic acid, acrylonitrile or vinyl chloride. Examples of such polymers are poly(ethylene-co-ethyl acrylate), poly(ethylene-co-vinyl acetate), poly(ethylene-co-vinyl chloride) and poly(styrene-co-acrylonitrile).

Graft copolymers and polymer blends, i.e. mixtures of polymers in which, amongst others, the above mentioned polymers are contained, for example polyethylene- and polypropylene-based polymer blends, are also suitable.

Further, the composition used according to the invention is suitable for providing a permanent hydrophilic finishing of polyester fibers, in particular of fibers made of polyethylene terephthalate and polylactides, and of non-wovens made thereof. Bicomponent fibers made of polyolefines and polyesters are also suitable.

For use as a spin finish or finishing agent, it is preferred that the preferably granular composition is dispersed in water or another suitable solvent and applied to the fiber or the non-woven in the form of a diluted aqueous dispersion containing active components in a proportion of 1 to 5 weight percent. The dispersion can be applied onto the non-woven by known means such as dosing pens, kiss rollers, immersion baths or by spraying. The composition's oil pick-up (OPU) is preferably in the range of 0.1 to 5%, based on the dry weight of each product (fiber, filament, non-woven).

Another object of the invention comprises textile fibers and filaments and textile products made thereof, especially nonwovens, that are produced by the above mentioned method and provided or treated with the composition according to the invention as a permanent hydrophilic finish.

The invention also comprises a double finishing and treatment of textile fibers and non-wovens made of polyolefin or polyester, in which first the fibers and filaments are provided with a permanent hydrophilic finish and then the non-woven made thereof, as a whole, is once again treated according to the invention with the composition as a permanent hydrophilic finish.

According to a preferred embodiment the non-woven provided with the composition according to the invention as a finish forms part of an absorption article. A device is called an absorption article if it is to be positioned on the skin of the wearer to absorb and retain the various substances excreted by the body. Examples of absorption articles are incontinence articles such as diapers, pant-like diapers, training pants, diaper holders and incontinence panties as well as feminine hygiene products such as tampons, sanitary towels and panty liners.

The absorption article usually comprises a basic unit made of a liquid-permeable top layer and a bottom layer as well as an absorption core located between the top layer and the bottom layer that serves to absorb body fluids. The liquid-permeable top layer is directed towards the wearer if he/she is wearing the article. The opposite bottom layer is located on the side that points to the clothing of the wearer. At least the top layer is made of a non-woven provided with the composition according to the invention as a finish.

The following exemplary embodiments serve to illustrate the invention and are not to be considered as limiting.

Examples 1 to 3

The components specified in the following Table 1 were melted, thoroughly mixed with each other and granulated from the melt. The medium grain size of the granules was 5 mm. Then a 5% aqueous dispersion was produced from the granules so obtained. This dispersion was applied onto a SSS spun-bonded non-woven made of polypropylene fibers having a weight per unit area of 15 g/m$^2$. The oil pick-up was set to 0.5%, based on the dry weight of the non-woven.

TABLE 1

| Components | Example 1 | Example 2 | Example 3 |
|---|---|---|---|
| Component (A) | | | |
| Cationically modified siloxane; viscosity (22° C.) 68 Pas | 10 | 22.2 | 20.2 |
| Non-ionic hydrophilically modified siloxane; viscosity (22° C.) 0.2 Pas | | | 1.0 |
| Component (B) | | | |
| Esterquat made of C16/18 fatty acid, triethanolamine and dimethyl sulfate; melting point 63° C. | 52 | 4.5 | 40.4 |
| Component (C) | | | |
| Cetyl/stearyl alcohol Melting point approx. 55° C. | 13 | 11.1 | 0.1 |
| Component (D) | | | |
| Glycerol monostearate/distearate Melting point 62° C. | 25 | 22.2 | 20.2 |
| Cetyl/stearyl alcohol ethoxylate | | | 5.1 |
| Component (E) | | | |
| Oleyl/cetyl alcohol ethoxylate, 4 EO | | | 3.0 |

Comparative Example

For comparison with the compositions according to the invention a finishing agent commercially available as an aqueous dispersion was set to a content of active components of 5% and applied with an OPU of 0.5% onto a SSS spun-bonded non-woven made of polypropylene fibers having a weight per unit area of 15 g/m$^2$.

For testing the compositions pursuant to Examples 1 to 3 in conjunction with the PP spun-bonded non-woven provided with these compositions as a finish, the tests described below were performed.

Multiple Strike-Through

Pursuant to standard test EDANA WSP 70.7 (11) the time needed for 5 ml of a synthetic urine solution to permeate a finished non-woven and to access the underlying absorption layer made of filter paper is measured. The measurement is performed on the same non-woven fife times in a row, with the absorption filter paper changed every time, to test whether the hydrophilizing finish is washed off or indeed permanently hydrophilizing. The five measured values are stated in seconds. A permanent hydrophilization is deemed achieved if the measured values meet the following limits: <2/<31<51<5/<5.

Wetback

Pursuant to standard test EDANA WSP 80.10 (09) A the amount (in grams) of liquid flowing back in dry filter paper laid across a wetted non-woven loaded with a 4 kg weight is measured. The wetback test is considered as passed if the amount of liquid flowing back is less than 0.6 g.

Multiple Run-Off Test

Following WSP method 80.9 the PP spun-bonded non-woven is put on a filter paper serving as an absorption layer at an angle of 25°. A defined amount of a synthetic urine solution is applied. Any test liquid that is not adsorbed is collected in a collecting tray and the amount is determined by weighing. The test is repeated twice on the same non-woven. Ideally, the amount of artificial urine solution not absorbed should be 0% in the first run.

Wash-Off Test

According to an in-house test method the surface tension of a wash solution resulting from the wash-off of a 6×6 cm piece of non-woven with 40 ml demineralized water is measured. The non-woven is stirred in the water for 10 seconds at room temperature (25° C.). Then, the non-woven is removed using tweezers and the surface tension of the washing water at 25° C. is measured by means of a platinum ring. The wash solution should exhibit a surface tension of at least 60 mN/m.

The test results obtained for the composition according to Examples 1 to 3 are stated in Table 2 below.

TABLE 2

| Test results | | | | | |
|---|---|---|---|---|---|
| Property | Nominal value | Example 1 | Example 2 | Example 3 | Comparison (commercial dispersion) |
| 1. Strike-through (s) | <2 | 1.52 | 1.45 | 1.63 | 1.57 |
| 2. Strike-through (s) | <3 | 2.59 | 2.36 | 2.77 | 2.90 |
| 3. Strike-through (s) | <5 | 2.78 | 2.46 | 2.86 | 3.16 |
| 4. Strike-through (s) | <5 | 2.93 | 2.60 | 3.02 | 3.79 |
| 5. Strike-through (s) | <5 | 3.38 | 2.88 | 3.26 | 6.19 |
| Wetback (g) | <0.6 | 0.18 | 0.16 | 0.24 | 0.24 |
| 1. Run-off (%) | 0 | 0 | 0 | 0 | 0 |
| 2. Run-off (%) | <5 | 0 | 0 | 0.3 | 0 |
| 3. Run Off (%) | <30 | 0.5 | 1.2 | 0.3 | 14.5 |
| Wash-off/STR (mN/m) | >60 | 71.6 | 71.6 | 69.7 | 70.0 |

Thus, Examples 1 to 3 according to the invention meet the requirements for a fast and permanent hydrophilic finishing of the polyolefin non-woven. At the same time, the compositions are storage stable for at least 12 months and, in the form of a granulate, do not show any visible changes in the warm storage test for 3 days at 50° C.

The invention claimed is:

1. A composition for permanent hydrophilic finishing of polyolefin fibers, polyester fibers and bicomponent fibers made of polyolefins and polyesters, and textile products made thereof, consisting of:

(A) a hydrophilically modified polyalkylsiloxane in a proportion of 3 to 30 weight percent;

(B) a cationic surfactant based on a quaternary ammonium compound in a proportion of 25 to 85 weight percent, the quaternary ammonium compound having a melting point of at least 45° C.;

(C) an, optionally hydroxylated, fatty alcohol having a melting point of at least 40° C. in a proportion of 0 to 25 weight percent;

(D) a non-ionic consistency enhancer in a proportion of 0 to 40 weight percent, the consistency enhancer having a melting point of at least 45° C. and being selected from the group consisting of alkoxylated C12-C28 fatty alcohols, optionally alkoxylated C12-C28 fatty acid amides, alkoxylated C12-C28 fatty acids, alkoxylated C12-C28 fatty acid esters and optionally alkoxylated C12-C28 fatty acid esters of polyfunctional alcohols, C12-C22 alkyl polyglycosides, synthetic and natural waxes and any mixture thereof; and (E) a hydrotropic dispersion additive in a proportion of 0 to 10 weight percent, based on the total weight of the composition;

the composition having a melting point of at least 45° C.

2. The composition according to claim 1, characterized in that the melting point of the composition is at least 55° C.

3. The composition according to claim 1, characterized in that the polyalkylsiloxane comprises a cationically modified polyalkylsiloxane having a quaternary ammonium group.

4. The composition according to claim 3, characterized in that the cationically modified polyalkylsiloxane corresponds to the following formulas Ia or Ib:

(Ia)

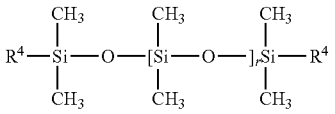

(Ib)

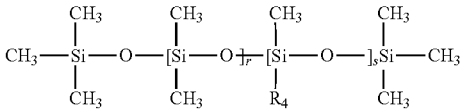

wherein $R^4$ is

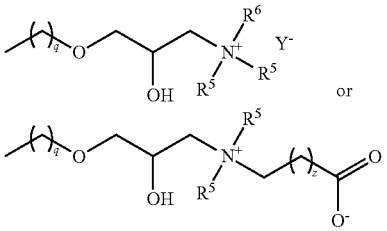

$R^5$ is, independently from each other, —$CH_3$ or —$C_2H_4OH$, $R^6$ is —$(CH_2)_x$—X—CO—$R^7$, $R^7$ is a linear or branched, saturated or unsaturated hydrocarbon chain with 9 to 23 C-atoms, X is an oxygen atom or NH, $Y^-$ is one of the anions $CH_3OSO_3^-$, $C_2H_5OSO_3^-$, $CH_3COO^-$, $Cl^-$, phosphate or lactate, q is an integer from 3 to 8, r and s are, independently from each other, an integer from 1 to 50, x is an integer from 2 to 10, y is an integer from 8 to 22, and z is an integer from 0 to 10.

5. The composition according to claim 1, characterized in that the hydrophilically modified polyalkylsiloxane has a viscosity at 22° C. of at least 5,000 mPa s.

6. The composition according to claim 1, characterized in that the quaternary ammonium compound has a melting point of at least 55° C.

7. The composition according to claim 1, characterized in that the quaternary ammonium compound corresponds to the following formula II:

$$[(R^1—C(=O)—X—(CH_2)_n—)_mNR^2_{4-m}]^+Y^- \quad (II)$$

wherein $R^1$ can be equal or different and is an alkyl group having 1 to 24 C-atoms or an alkenyl group having 2 to 24 C-atoms;

$R^2$ can be equal or different and, independent from each other, is an alkyl group having 1 to 24 C-atoms, an alkenyl group having 2 to 24 C-atoms, hydroxyethyl or a polyglycol residue;

X is an oxygen atom, NH, N—$CH_3$ or a $(OC_2H_4)_z$ group with z=1 to 10;

$Y^-$ is one the anions $CH_3OSO_3^-$, $C_2H_5OSO_3^-$, $CH_3COO^-$, $Cl^-$, phosphate, lactate and citrate;

N is an integer from 1 to 6; and

M is an integer from 1 to 3.

8. The composition according to claim 1, characterized in that the composition contains at least one, optionally hydroxylated, C16-C32 fatty alcohol.

9. The composition according to claim 8, characterized in that the fatty alcohol is selected from the group consisting of cetyl alcohol, hydroxystearyl alcohol or any mixture thereof.

10. The composition according to claim 1, characterized in that the composition includes a consistency enhancer having a melting point of at least 55° C.

11. The composition according to claim 1, characterized in that the composition contains a consistency enhancer formed from the ester of a C12-C28 fatty acid with a polyfunctional alcohol, the polyfunctional alcohol being selected from the group consisting of sorbitol, neopentylglycol, glycerol, trimethylolpropane, pentaerythritol and polyglycerol, glucose and polyglycosides and any mixture thereof.

12. The composition according to any of claim 1, characterized in that the hydrotropic dispersion additive is selected from the group consisting of C6-C18 alkyl alkoxylates, amphoteric surfactants, (poly)phosphates, polyvinyl alcohols, polyacrylates and/or sulfonates.

13. The composition according to claim 1, consisting of:

10 to 25 weight percent of the hydrophilically modified polyalkylsiloxane of component (A);

40 to 55 weight percent of the quaternary ammonium compound of component (B);

10 to 15 weight percent of the fatty alcohol of component (C);

20 to 30 weight percent of the consistency enhancer of component (D), selected from the group consisting of C12-C28 fatty acid esters of polyfunctional alcohols, C12-C28 fatty alcohol ethoxylates, vegetable waxes and C12-C22 alkyl polyglycosides and any mixture thereof; and 0 to 5 weight percent of the hydrotropic dispersion additive of component (D).

14. The composition according to claim 1, characterized in that the composition is present as a granulate or in an aqueous dispersion having a solids content of at least 10 weight percent.

15. A textile fiber or textile filament made of polyolefin and/or polyester, finished or treated with a composition according to claim 1 as a permanent hydrophilic finish.

16. A non-woven textile fabric made of polyolefin fibers or filaments and/or polyester fibers or polyester filaments that is finished with the composition according to claim 1 as a permanent hydrophilic finish.

17. The composition according to claim 14 wherein the solids content is at least 15 weight percent.

* * * * *